US012805629B2

(12) United States Patent
Arsenault

(10) Patent No.: US 12,805,629 B2
(45) Date of Patent: Nov. 24, 2026

(54) REMOVABLE WORK SURFACE

(71) Applicant: Donald Joseph Arsenault, Summerside (CA)

(72) Inventor: Donald Joseph Arsenault, Summerside (CA)

( * ) Notice: Subject to any disclaimer, the term of this patent is extended or adjusted under 35 U.S.C. 154(b) by 88 days.

(21) Appl. No.: 18/792,083

(22) Filed: Aug. 1, 2024

(65) Prior Publication Data

US 2026/0033624 A1 Feb. 5, 2026

(51) Int. Cl.
*A47B 5/02* (2006.01)

(52) U.S. Cl.
CPC ..... *A47B 5/02* (2013.01)

(58) Field of Classification Search
CPC ..... A47B 5/02
See application file for complete search history.

(56) References Cited

U.S. PATENT DOCUMENTS

| | | | | |
|---|---|---|---|---|
| 1,098,945 A | | 6/1914 | Frederick | |
| 1,758,440 A | * | 5/1930 | Goodwin | E04G 5/06 248/245 |
| 3,272,467 A | | 9/1966 | Kassube | |
| 3,595,510 A | * | 7/1971 | Hutchinson | E04G 5/06 182/113 |
| 3,706,105 A | * | 12/1972 | Nicholas | A47D 13/06 5/93.1 |
| 3,837,597 A | | 9/1974 | Bourhenne | |
| 4,214,718 A | | 7/1980 | Silkey | |
| 4,452,336 A | * | 6/1984 | Sickler | E04G 5/04 248/216.1 |
| 4,908,982 A | | 3/1990 | Quatrini | |
| 4,984,763 A | | 1/1991 | O'Donnell | |
| 5,395,081 A | | 3/1995 | Vollink | |
| 5,407,025 A | | 4/1995 | Nickel | |
| 5,535,974 A | * | 7/1996 | Savitski | E04G 5/06 248/246 |

(Continued)

FOREIGN PATENT DOCUMENTS

| | | | | |
|---|---|---|---|---|
| EP | 985366 A2 | * | 3/2000 | |
| EP | 2491817 A1 | | 8/2012 | |
| FR | 3093625 A1 | * | 9/2020 | A47B 96/07 |

OTHER PUBLICATIONS

Green Flash Desk, https://greenflashdesk.com/, retrieved on Aug. 6, 2024.

*Primary Examiner* — Hanh V Tran
(74) *Attorney, Agent, or Firm* — BCF LLP

(57) ABSTRACT

Removable work surface includes a frame defining first and second lateral sides, a supporting surface connected to the frame, and first, second, third and fourth fingers connected to the frame. The first and second fingers extend laterally outwardly from the first lateral side of the frame, and are spaced from one another along a length of the first lateral side. The third and fourth fingers extend laterally outwardly from the second lateral side of the frame, and are spaced from one another along a length of the second lateral side. The first and second fingers and part of the first lateral side form a c-shape, with a space defined between outer ends of the first and second fingers being open. The third and fourth fingers and part of the second lateral side form a c-shape, with a space defined between outer ends of the third and fourth fingers being open.

20 Claims, 7 Drawing Sheets

(56) References Cited

U.S. PATENT DOCUMENTS 5,607,091 A * 3/1997 Musacchia ..... A01M 31/004 224/267
5,860,370 A * 1/1999 Poniecki ..... A47B 96/025 248/219.3
5,931,102 A * 8/1999 Grahl ..... F16M 11/2014 248/278.1
5,970,887 A * 10/1999 Hardy ..... A47B 46/00 211/187
6,079,777 A * 6/2000 Simmons ..... A47C 13/00 297/30
6,098,552 A * 8/2000 Gunderson ..... A47B 57/567 211/187
6,367,754 B1 * 4/2002 Cinker ..... B65H 49/325 242/129
6,374,751 B1 * 4/2002 With ..... G06F 3/0395 100/90
6,375,141 B1 4/2002 Kettlestrings
6,971,204 B1 12/2005 Gibney
6,983,824 B1 * 1/2006 Dandurand ..... E04G 1/38 182/150
7,341,229 B1 3/2008 Flowers
8,015,929 B2 * 9/2011 Tyner ..... F16M 11/24 108/42
8,061,665 B2 * 11/2011 Solis ..... E04G 5/062 248/219.3
9,072,380 B2 * 7/2015 Durgin ..... A47B 96/07
D880,277 S 4/2020 Perry
D907,471 S 1/2021 Clark
2003/0226944 A1 * 12/2003 Sode ..... E04G 5/06 248/250
2004/0065770 A1 4/2004 Stone
2004/0129496 A1 7/2004 Clark
2016/0312478 A1 10/2016 Klapperich
2018/0073801 A1 * 3/2018 Murphy ..... F25D 25/02
2023/0072609 A1 * 3/2023 Gobeille ..... E04G 5/067

* cited by examiner

REMOVABLE WORK SURFACE

TECHNOLOGICAL FIELD

The present technology relates to removable work surfaces.

BACKGROUND

Work surfaces such as tables and desks can be useful in various settings in order to examine blueprints, organize documents and/or formulate plans.

Installing a work surface in some environments can be difficult. For instance, at a construction site, some work surfaces can be difficult to move around, can be difficult to assemble and/or can come in the way of workers.

Thus, there is a desire for a technology that can be quickly and removably set-up in various settings.

SUMMARY

It is an object of the present technology to ameliorate at least some of the inconveniences present in the prior art.

According to an aspect of the present technology, there is provided a removable work surface including a frame, a supporting surface, a first finger, a second finger, a third finger and a fourth finger. The frame defines a first lateral side and a second lateral side. The supporting surface is connected to the frame. The first finger is connected to the frame, and extends laterally outwardly from the first lateral side of the frame. The second finger is connected to the frame, extends laterally outwardly from the first lateral side of the frame, and is spaced from the first finger along a length of the first lateral side of the frame. The third finger is connected to the frame, and extends laterally outwardly from the second lateral side of the frame. The fourth finger is connected to the frame, extends laterally outwardly from the second lateral side of the frame, and is spaced from the third finger along a length of the second lateral side of the frame. The first finger, the second finger and part of the first lateral side of the frame generally form a c-shape, with a space defined between outer ends of the first finger and the second finger being open. The third finger, the fourth finger and part of the second lateral side of the frame generally form a c-shape, with a space defined between outer ends of the third finger and the fourth finger being open.

In some embodiments, the removable work surface is configured to be selectively mounted to a supporting assembly. The supporting assembly has a first supporting member with a first surface and a second surface that is opposite the first surface, and a second supporting member laterally spaced from the first supporting member. The second supporting member has a third surface and a fourth surface that is opposite the third surface. With the removable work surface being connected to the supporting assembly the first finger abuts the first surface, the second finger abuts the second surface, the third finger abuts the third surface, and the fourth finger abuts the fourth surface.

In some embodiments, the removable work surface includes a gripping member connected to one of the first finger, the second finger, the third finger, and the fourth finger.

In some embodiments, a position of the gripping member relative to the one of the first finger, the second finger, the third finger, and the fourth finger is adjustable.

In some embodiments, the gripping member is threadedly engaged to the one of the first finger, the second finger, the third finger, and the fourth finger.

In some embodiments, the gripping member is a pin.

In some embodiments, the pin is oriented at an angle with respect to the supporting surface.

In some embodiments, the angle is an acute angle extending below the supporting surface.

In some embodiments, the first finger is a first rear finger, the second finger is a first front finger, the third finger is a second rear finger, the fourth finger is a second front finger, and the gripping member is connected to one of the first rear finger and the second rear finger.

In some embodiments, the gripping member is a first gripping member connected to one of the first finger and the second finger; and the removable work surface further comprises a second gripping member connected to one of the third finger and the fourth finger.

In some embodiments, the first finger is a first rear finger, the second finger is a first front finger, the third finger is a second rear finger, the fourth finger is a second front finger, the first gripping member is connected to the first rear finger, and the second gripping member is connected to the second rear finger.

In some embodiments, the frame includes a first frame member, a second frame member, a first connecting member and a second connecting member. The first frame member is disposed on the first lateral side. The second frame member is disposed on the second lateral side. The first connecting member is connected to the first frame member and is selectively moveable relative to the first frame member between a first position and a second position. The second connecting member is connected to the second frame member and is selectively moveable between a third position and a fourth position. The first finger is connected to the first frame member. The second finger is connected to the first connecting member. The third finger is connected to the second frame member. The fourth finger is connected to the second connecting member.

In some embodiments, the first frame member is at least partially hollow, and the first connecting member is received in part in the first frame member, and the second frame member is at least partially hollow, and the second connecting member is received in part in the second frame member.

In some embodiments, each one of the first frame member and the second frame member defines a first aperture, and each one of the first connecting member and the second connecting member defines a second aperture and a third aperture. The removable work surface further includes a first peg and a second peg. With the first connecting member being in the first position relative to the first frame member, the first aperture of the first frame member is aligned with the second aperture of the first connecting member, and the first peg is received in the first aperture of the first frame member and the second aperture of the first connecting member. With the first connecting member being in the second position relative to the first frame member, the first aperture of the first frame member is aligned with the third aperture of the first connecting member, and the first peg is received in the first aperture of the first frame member and the third aperture of the first connecting member. With the second connecting member being in the third position relative to the second frame member, the first aperture of the second frame member is aligned with the second aperture of the second connecting member, and the second peg is received in the first aperture of the second frame member and the second aperture of the second connecting member.

With the second connecting member in the fourth position relative to the second frame member, the first aperture of the second frame member is aligned with the third aperture and the second peg is received in the first aperture of the second frame member and the third aperture of the second connecting member.

In some embodiments, the supporting surface is generally flat.

In some embodiments, the removable work surface, further includes a lip member extending at least partially between the first lateral side and the second lateral side. The lip member is disposed at a rear end of the supporting surface.

In some embodiments, the removable work surface further includes a retainer connected to at least one of the frame and the supporting surface.

In some embodiments, the retainer is connected to the frame, and extends from the first lateral side to the second lateral side.

In some embodiments, the retainer is an elastic cord.

In some embodiments, the frame defines a channel slidingly receiving the supporting surface.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

In the context of the following description, terms related to spatial orientation when referring to the removable work surface and components related thereto are as they would be understood by someone standing in front of the removable work surface while it is connected to a supporting assembly.

In the present application, expressions of the type: "at least one of A and B" should be understood to mean only A, only B, or both A and B.

Additional and/or alternative features, aspects, and advantages of embodiments of the present technology will become apparent from the following description and the accompanying drawings.

BRIEF DESCRIPTION OF THE DRAWINGS

For a better understanding of the present technology, as well as other aspects and further features thereof, reference is made to the following description which is to be used in conjunction with the accompanying drawings, where.

Unless indicated otherwise, the Figures are not drawn to scale.

DETAILED DESCRIPTION

Figure 1:
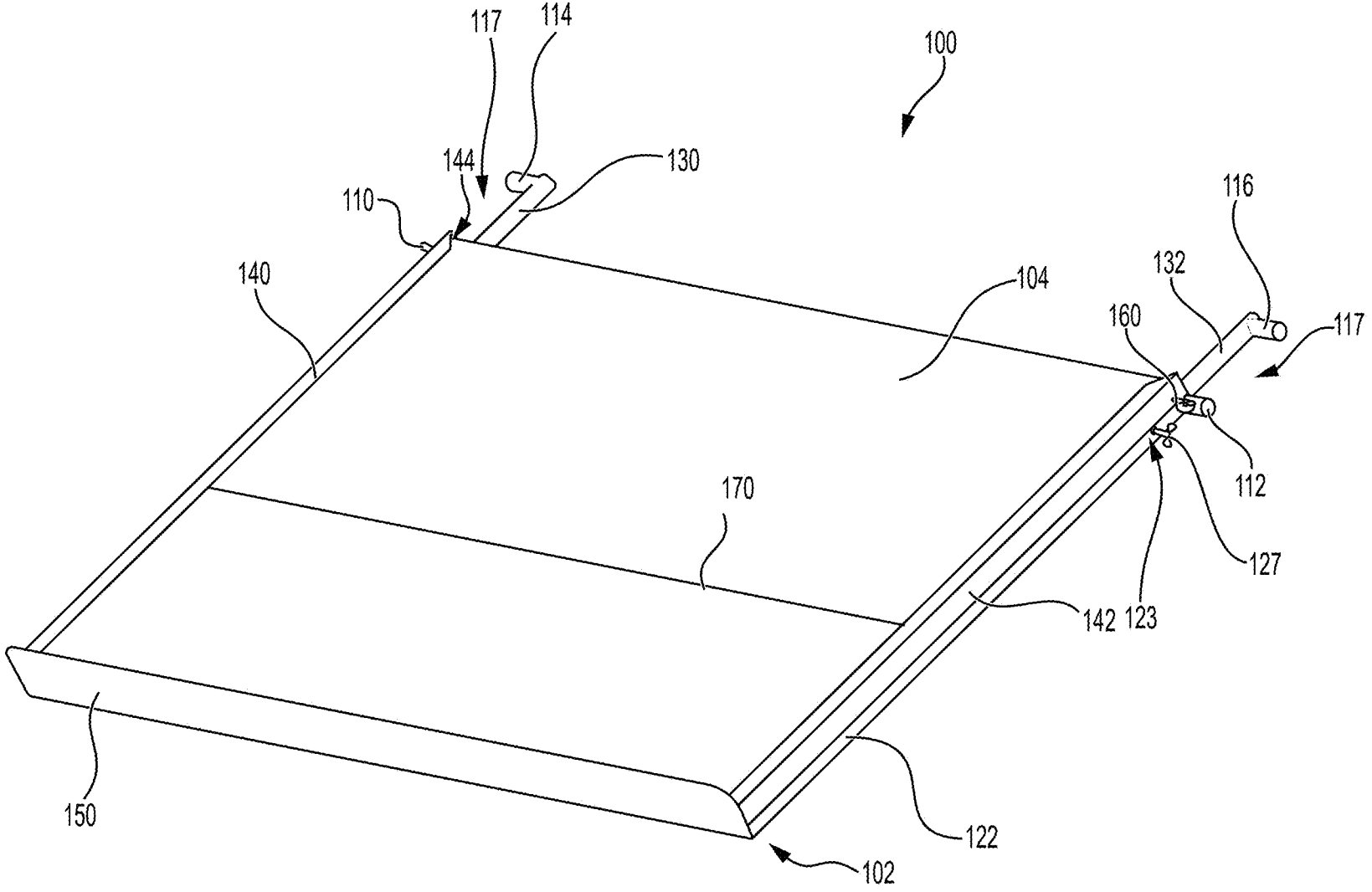
FIG. 1 is a perspective view taken from a top, rear, right side of a removable work surface according to an embodiment of the present technology, with left and right connecting members of the removable work surface being in a retracted position.

A removable work surface 100 in accordance to an embodiment of the present technology is shown in FIG. 1. The removable work surface 100 has a frame 102 and a supporting surface 104 connected to the frame 102. The removable work surface 100 also includes a rear left finger 110, a rear right finger 112, a front left finger 114 and a front right finger 116, all of which are connected to the frame 102. As will be described below, the removable work surface 100 is removably connected to a supporting assembly 101 via the fingers 110, 112, 114, 116.

Referring to FIGS. 1 to 4, the frame 102 includes a left frame member 120, a right frame member 122, a front frame member 124 and a rear frame member 126. The frame 102 also includes left and right connecting members 130, 132, left and right slider members 140, 142 and a lip member 150. It is contemplated that in some embodiments, the frame 102 may include more or fewer members. For example, in some embodiments, the frame 102 could only include left and right frame members that connected to the supporting surface 104, such that the front and rear frame members 124, 126 could be omitted. It is also contemplated that only one of the front and rear frame members 124, 126 could be omitted. In the present embodiment, the frame 102 is made of aluminium. However, it is contemplated that the frame 102 may be made of another material such as wood or plastic.

The left frame member 120 is disposed on a left side of the frame 102, the right frame member 122 is disposed on a right side of the frame 102, the front frame member 124 is disposed on a front side of the frame 102 (which may be referred to as an upper side of the frame 102) and the rear frame member 126 is disposed on a rear side of the frame 102 (which may be referred to as a lower side of the frame 102). The left frame member 120, the right frame member 122, the left connecting member 130 and the right connecting member 132 form the lateral sides of the frame 102. The front and rear frame members 124, 126 extend between the left and right frame members 120, 122.

In the present embodiment, the frame members 120, 122, 124, 126 are made of distinct pieces that are connected together via welding. It is contemplated that in other embodiments, the frame members 120, 122, 124, 126 could be connected differently. For example, the frame members 120, 122, 124, 126 could be selectively connected to one another via threaded fasteners. In another example, the frame members 120, 122, 124, 126 could be connected to one another via adhesive. It is also contemplated that in some embodiments, the frame members 120, 122, 124, 126 may be provided as one integral component.

Figure 3:
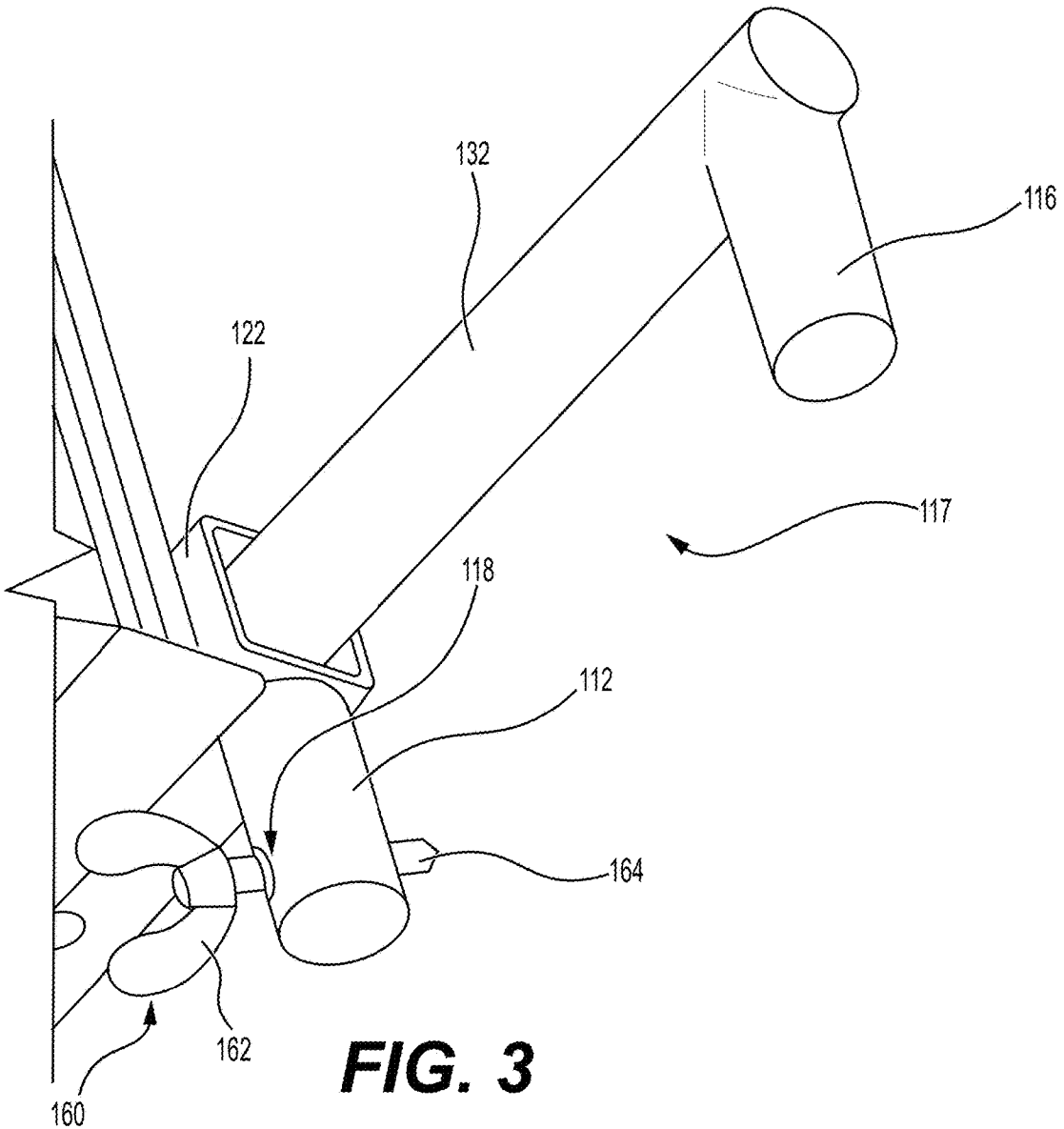
FIG. 3 is a close-up perspective view taken from a top, rear, right side of part of the removable work surface of FIG. 1.

Each one of the left and right frame members 120, 122 is hollow, with each one of the left and right frame members 120, 122 having an open-ended front end (open-ended front end of the right frame member 122 being shown in FIG. 3). It is contemplated that in some embodiments, each one of the left and right frame members 120, 122 could be partially hollow, with at least the front portions thereof being hollow. The left and right frame members 120, 122 are configured to receive the left and right connecting members 130, 132 respectively via their open-ended front ends. It is contemplated that the left and right frame members 120, 122 could be solid, and that the left and right connecting members 130, 132 could be connected differently to the left and right frame members 120, 122 respectively. For example, the left and right connecting members 130, 132 could slide over the left and right frame members 120, 122 respectively, or could be disposed next to the left and right frame members 120, 122 respectively.

The left frame member 120 defines an aperture 121, and the right frame member 122 defines an aperture 123. The apertures 121, 123 extend in the lateral direction. As will be described below, the apertures 121, 123 are configured to receive, respectively, positioning pegs 125, 127 therein.

The left frame member 120 has the rear left finger 110 connected thereto, and the right frame member 122 has the rear right finger 112 connected thereto. As the rear left and right fingers 110, 112 are similar, only the rear right finger 112 will be described in detail herein.

The rear right finger 112 extends laterally outwardly from the right frame member 122 and is generally cylindrical. In the present embodiment, the rear right finger 112 extends perpendicularly to the right frame member 122. In the present embodiment, the rear right finger 112 is welded to the right frame member 122. However, it is contemplated that the rear right finger 112 may be connected to the right frame member 122 differently, for example via a fastener or an adhesive.

The rear right finger 112 is generally cylindrical. The rear right finger 112 defines an aperture 118 (FIG. 3) in which a gripping member 160 is received. The aperture 118 is a threaded through aperture, and the gripping member 160 is partially threaded, such that the gripping member 160 and the aperture 118 are threadedly engaged to one another. As will be described below, this threaded engagement enables a position of the gripping member 160 to be adjusted relative to the rear right finger 112.

Referring to FIG. 3, in the present embodiment, the gripping member 160 is a pin 160, and will henceforth be referred to as such. The pin 160 has a handling portion 162 and a pointed pinning portion 164 connected to the handling portion 160. The pin 160 is received through the aperture 118 such that the handling portion 162 is disposed on one side of the aperture 118, and the pinning portion 164 extends through the other side of the aperture 118. As will be described below, the pin 160 is configured to pin onto part of the supporting assembly 101, which can assist in preventing the removable work surface 100 from slipping down the supporting assembly 101. The handling portion 162 can facilitate manipulation of the pin 160. Specifically, the pin 160 can easily be grasped via the handling portion 162 for threading the pin in or out of the aperture 118. This can be done to adjust how much of the pinning portion 162 extends out of the aperture 118.

Figure 7:
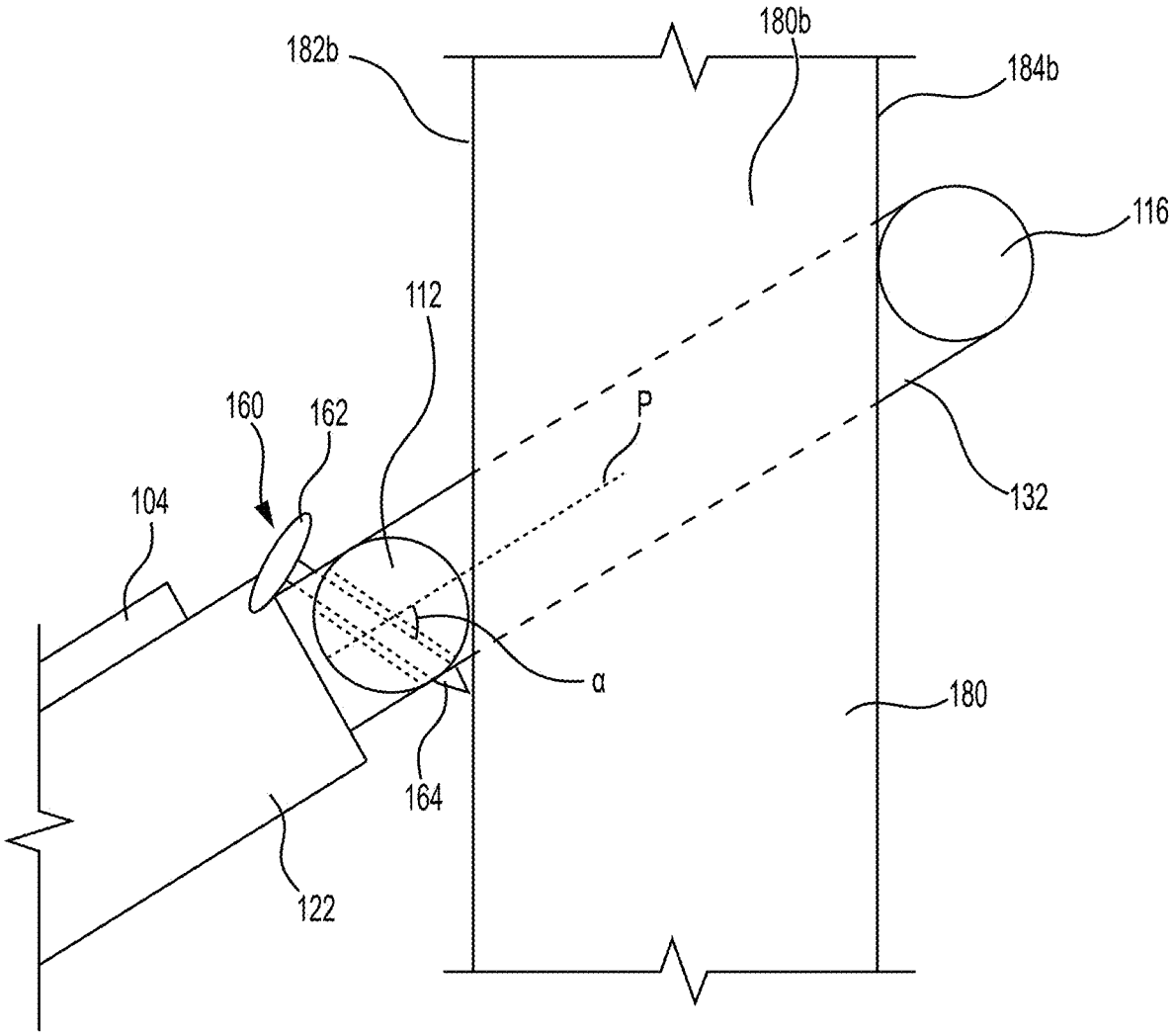
FIG. 7 is a right side elevation view of part of the removable work surface and the supporting assembly of FIG. 5.

Referring to FIG. 7, the aperture 118 and the pin 160 are oriented such that when the removable work surface 100 is connected to the supporting assembly 101, the pin 160 defines an angle $\alpha$ with respect to a plane P extending parallel to the supporting surface 104. The angle $\alpha$ is an acute angle. It is contemplated that in other embodiments, the orientation of the pin 160 may vary. For example, in some embodiments, when the removable work surface 104 is connected to the supporting assembly 101, the pin 160 may be oriented to be generally parallel to a horizontal plane.

It is contemplated that in some embodiments, only one of the rear left and right fingers 110, 112 could be provided with the pin 160. In other embodiments, the front left and/or right fingers 114, 116 could have the pin 160.

Referring to FIGS. 1 to 4, the left connecting member 130 is moveably connected to the left frame member 120, and the right connecting member 132 is moveably connected to the right frame member 122. More specifically, the left and right connecting members 130, 132 are partially received in, respectively, the left and right frame members 120, 122. It is contemplated that the left and right connecting members 130, 132 could be connected to the left and right frame members 120, 122 differently. For example, the left and right connecting members 130, 132 could be connected to, respectively, the left and right frame members 120, 122 via rails.

The left connecting member 130 defines two apertures 134, 135 that are spaced from one another along a length of the left connecting member 130. Similarly, the right connecting member 132 defines two apertures 136, 137 that are spaced from one another along a length of the right connecting member 132. The apertures 134, 135, 136, 137 extend in the lateral direction. It is contemplated that the left and right connecting members 130, 132 may define three or more apertures. It is also contemplated that the left and right connecting members 130, 132 could define a single aperture, and that the left and right frame members 120, 122 could define two or more apertures. As will be described in greater detail below, the apertures 134, 135 are configured to receive the positioning peg 125 therein, and the apertures 136, 137 are configured to receive the positioning peg 127.

At a front end thereof, the left connecting member 130 has the front left finger 114 connected thereto. Similarly, at a front end thereof, the right frame member 132 has the front right finger 116 connected thereto. The front left and right fingers 114, 116 are generally similar. Therefore, only the front right finger 116 will be described in detail herein.

The front right finger 116 extends laterally outwardly from the right connecting member 132 and is generally cylindrical. The front right finger 116 extends perpendicularly to the right connecting member 132. In the present embodiment, the front right finger 116 is welded to the right connecting member 132. However, it is contemplated that the front right finger 116 may be connected to the right connecting member 132 differently, for example via a fastener or an adhesive.

As best seen in FIG. 3, the rear right finger 112, part of the right connecting member 132 extending between the front and right fingers 112, 116 (i.e., part of the right lateral side of the frame 102), and the front right finger 116 generally define a C-shape. An open space 117 is defined between outer ends of the rear right finger 112 and the front right finger 116. As will be described below, that open space 117 is configured to receive part of the supporting assembly 101 therein. It is understood that the rear left finger 110, part of the left connecting member 130 extending between the front and right fingers 110, 114 (i.e., part of the left lateral side of the frame 102), and the front left finger 114 also define the C-shape with the open space 117, but that oriented in the opposite direction.

Figure 2:
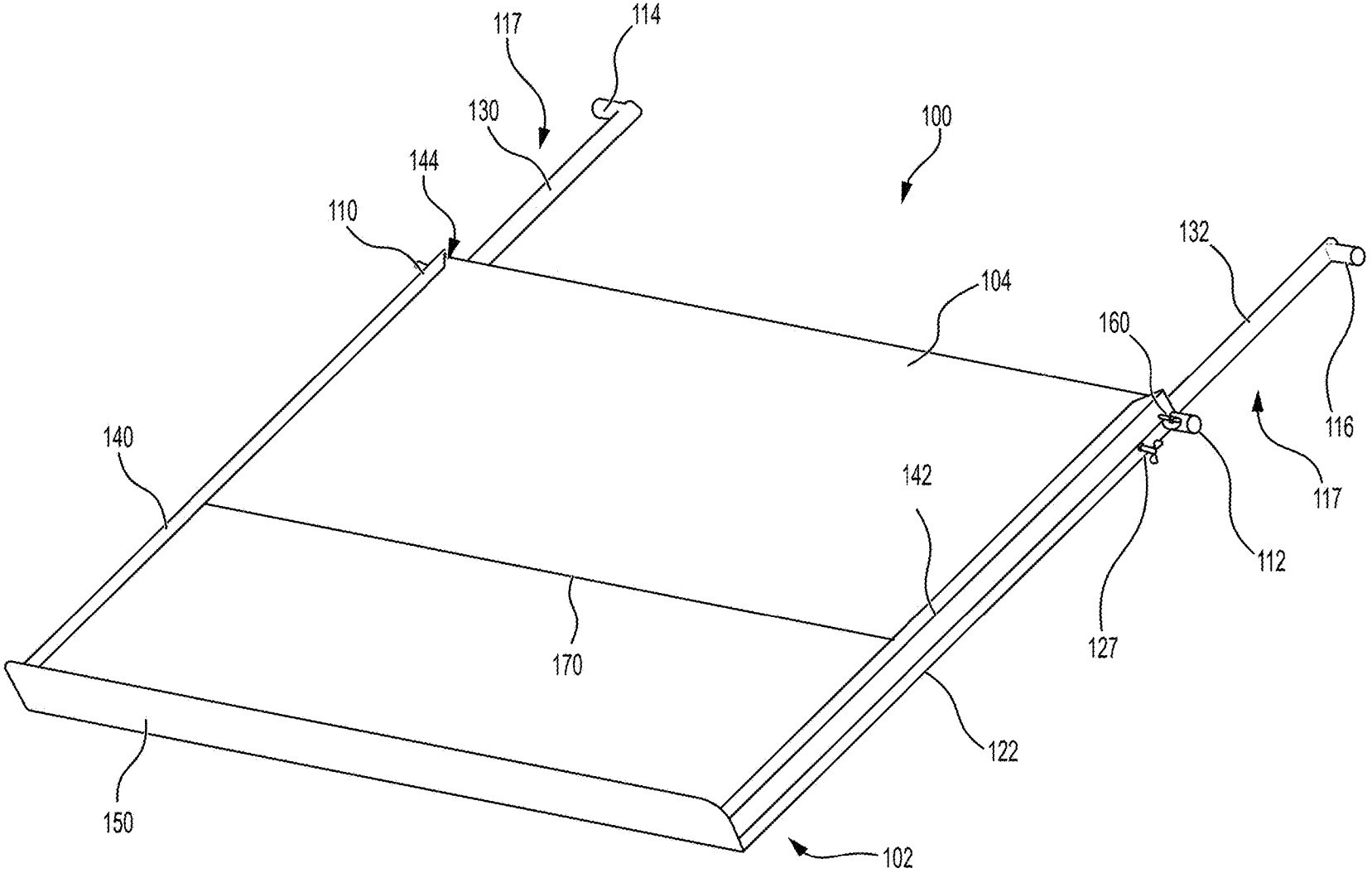
FIG. 2 is a perspective view taken from a top, rear, right side of the removable work surface of FIG. 1, with the left and right connecting members being in an extended position.

Each of the left and right connecting members 130, 132 is selectively moveable, with respect to, respectively, the left and right frame members 120, 122 between a retracted position (FIG. 1) and an extended position (FIG. 2). It is contemplated that the connecting members 130, 132 could be moveable between three or more positions.

Figure 4:
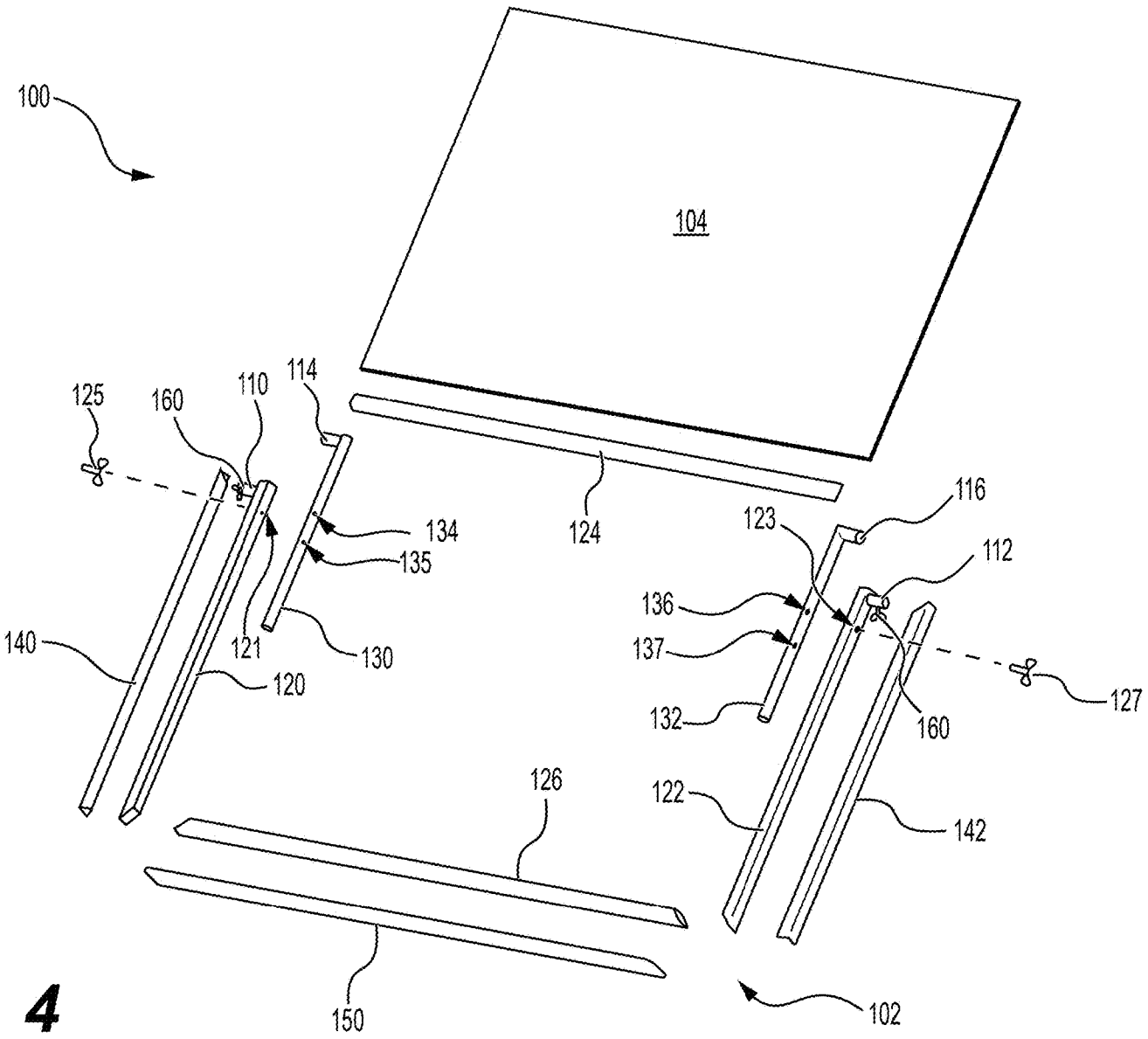
FIG. 4 is an exploded perspective view taken from a top, rear, right side of the removable work surface of FIG. 1.

Referring to FIGS. 1 and 4, when the left and right connecting members 130, 132 are in their retracted positions, the aperture 121 of the left frame member 120 is aligned with the aperture 134 of the left connecting member 130, and the aperture 123 of the right frame member 122 is aligned with the aperture 136 of the right connecting member 132. Additionally, the positioning peg 125 is received in the apertures 121, 134 and the positioning peg 127 is received in the apertures 123, 136 such that relative movement between the left connecting member 130 and the left frame member 120 and relative movement between the right connecting member 132 and the right frame member 122 are prevented.

Referring to FIGS. 2 and 4, when the left and right connecting members 130, 132 are in their extended positions, the aperture 121 of the left frame member 120 is aligned with the aperture 135 of the left connecting member 130, and the aperture 123 of the right frame member 122 is aligned with the aperture 137 of the right connecting member 132. Additionally, the positioning peg 125 is received in the apertures 121, 135 and the positioning peg 127 is received in the apertures 123, 137 such that relative movement between the left connecting member 130 and the left frame member 120 and relative movement between the right connecting member 132 and the right frame member 122 are prevented.

When the left and right connecting members 130, 132 are in their retracted positions, the front fingers 114, 116 are closer to the rear fingers 110, 112 than when the left and right connecting members 130, 132 are in their extended positions. Thus, the open space 117 is smaller when the left and right connecting members 130, 132 are in their retracted positions than when the left and right connecting members 130, 132 are in their extended positions.

In some instances, when the left and right connecting members 130, 132 are in their retracted positions, the open spaces 117 are sized to receive 2 in by 4 in (5.1 cm×10.2 cm) studs therein, whereas when the left and right connecting members 130, 132 are in their extended positions, the open spaces 117 are sized to receive 2 in by 6 in (5.1 cm×15.3 cm) studs. In some cases, the removable work surface 100 can be connected to 2 in by 4 in (5.1 cm×10.2 cm) studs while the left and right connecting members 130, 132 are in their extended positions to change the orientation of the removable work surface 104.

Still referring to FIGS. 1 to 4, the left slider member 140 is connected to the left frame member 120, and the right slider member 142 is connected to the right frame member 122. Channels 144 are defined between the slider members 140, 142 and the left and right frame members 120, 122. The channels 144 are configured to slidingly receive the supporting surface 104 therein. It is contemplated that in some embodiments, the left and right slider members 140, 142 could be omitted, such that the supporting surface 104 could be fixedly connected to the left and right frame members 120, 122.

The lip member 150 is connected to the lower frame member 126 and extends an entirety of a width of the supporting surface 104, such that the lip member 150 extends from the left frame member 120 to the right frame member 122. It is contemplated that the lip member 150 may only extend partially between the left and right sides of the removable work surface 100. The lip member 150 extends generally orthogonally to the supporting surface 104. It is contemplated that in other embodiments, the orientation of the lip member 150 may be skewed with respect to the supporting surface 104, such that an angle defined between the lip member 150 and the supporting surface 104 may be 90 degrees or less. The lip member 150 can assist in preventing documents and/or items like pencils from falling off the supporting surface 104. In some embodiments, the lip member 150 may be omitted.

Still referring to FIGS. 1 to 4, the supporting surface 104 is generally flat. It is contemplated that the supporting surface 104 could be made of a variety of material. It could be a plastic surface, a wooden surface or alternatively could be a re-markable surface such as a whiteboard. The supporting surface 104 is sized to be slidingly received between the slider members 140, 142.

The removable work surface 100 also includes a retainer 170. The retainer 170 is an elastic cord that is connected to the frame 102. More specifically, the retainer 170 has one end connected to the left frame member 120 and another end connected to the right frame member 122. The retainer 170 is generally flush on the supporting surface 104. Thus, the retainer 170 can be used to maintain documents such as blueprints disposed on the supporting surface 104 generally flat, and/or can be used to prevent documents from flying off the supporting surface 104.

Figure 5:
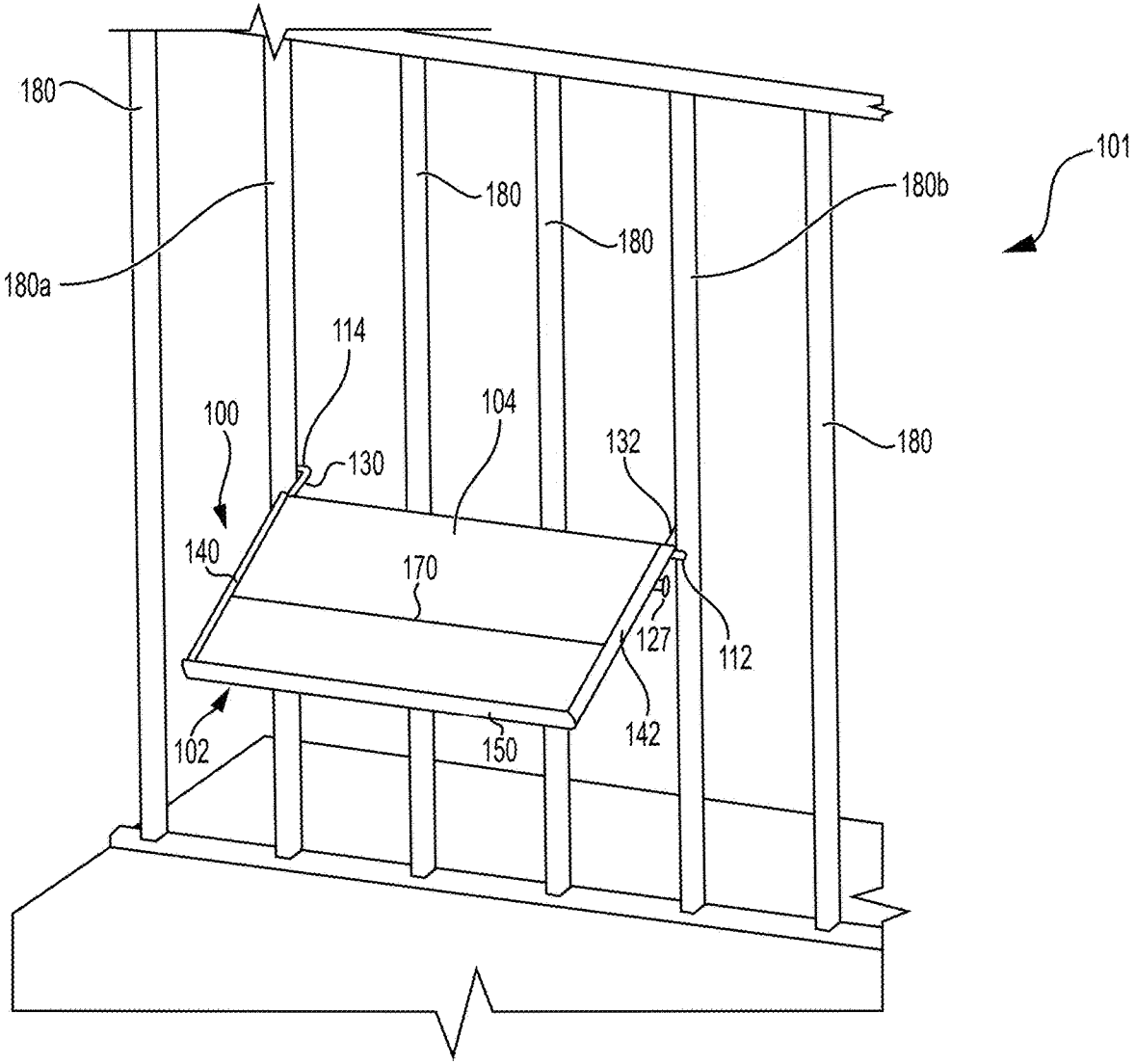
FIG. 5 is a perspective view taken from a top, rear, right side of the removable work surface of FIG. 1 connected to a supporting assembly.
Figure 6:
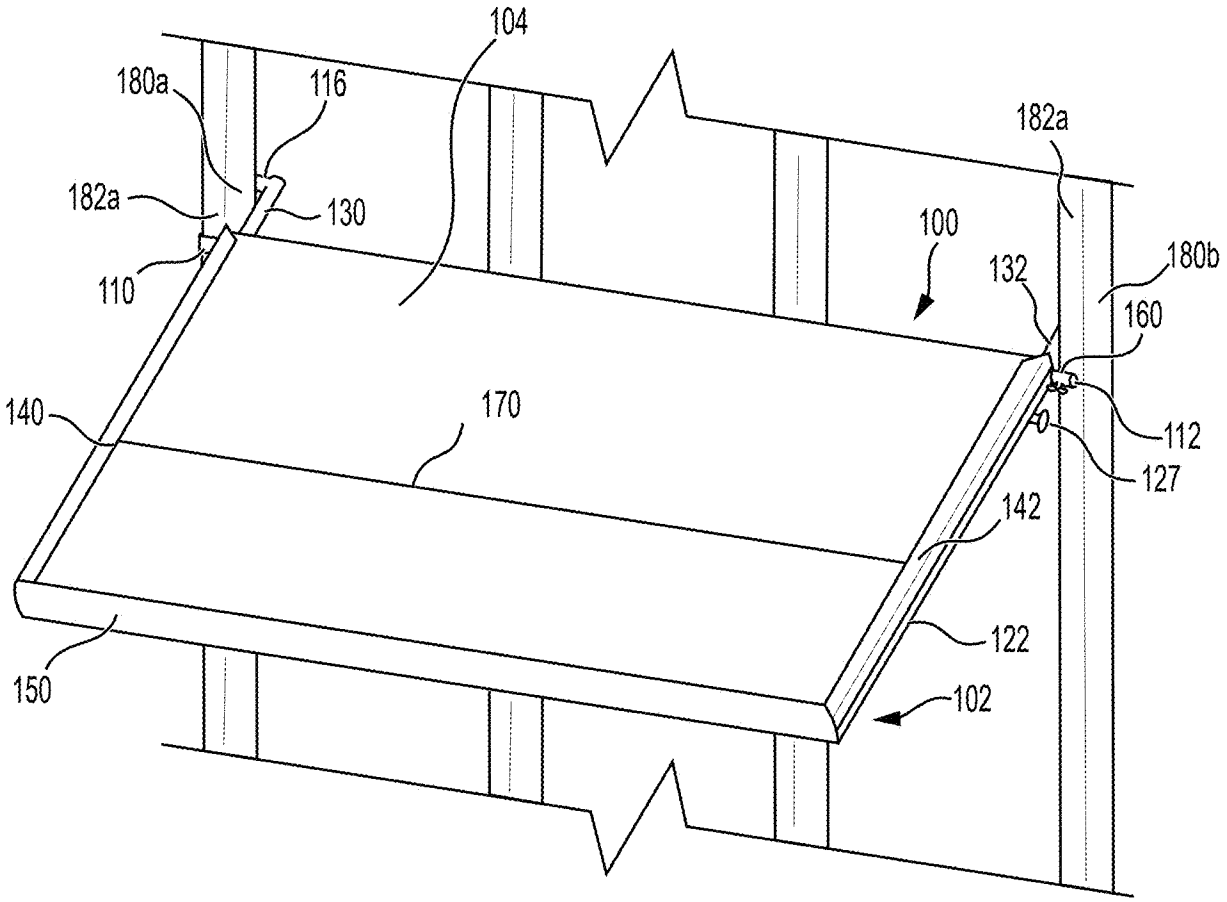
FIG. 6 is a close-up perspective view of the removable work surface and the supporting assembly of FIG. 5.

Referring to FIGS. 1, 5 and 6, the removable work surface 100 being connected to the supporting assembly 101 will now be described in greater detail. In the accompanying figures, the supporting assembly 101 is a framing wall 101 at a construction site, but other supporting assemblies are contemplated. The framing wall 101 has a plurality of studs 180 that extend in the vertical direction. The studs 180 are laterally spaced from one another. Each stud 180 has a surface 182 and a surface 184 opposite to the surface 182. Generally, the lateral spacing between the studs 180 from one framing wall 101 to another is constant. In some building codes, the center-to-center distance between two consecutive studs 180 has two be 12 in (30.5 cm). Thus, a width of the removable work surface 100 is configured to connect to studs 180*a*, 180*b*. The studs 180*a*, 180*b* are separated by two studs 180, such that the removable work surface 100 generally spans four studs 180. It is contemplated that the width of the removable work surface 100 may vary. For example, the removable work surface 100 could generally span two studs 180, three studs 180 or more than four studs 180.

Before connecting the removable work surface 100 to the supporting assembly 101, the removable work surface 100 is put in the appropriate configuration. More specifically, the left and right connecting members 130, 132 are moved to their retracted positions or to their extended positions. As mentioned above, the position of the left and right connecting members 130, 132 may depend on the size of the studs 180 or on the desired orientation of the removable work surface 100.

Then, the removable work surface 100 is laterally tilted such that one lateral side is vertically higher than the other lateral side. This enables the removable work surface 100 to be fit between the studs 180*a*, 180*b*. Once tilted, the removable work surface 100 is moved to align the open spaces 117 with the studs 180*a*, 180*b*. Then, the removable work surface 100 is straightened, such that the stud 180*a* is received in the open space 117 defined between the front and rear left fingers 110, 114, and the stud 180*b* is received in the open space 117 defined between the front and rear right fingers 112, 116. Then, the removable work surface 100 can be laterally straightened such that the removable work surface 100 is generally horizontal. At this point, the vertical position along the studs 180*a*, 180*b* of the removable work surface 100 can easily be adjusted. It will be appreciated that adjusting the vertical position of the removable work surface 100 is facilitated by the fingers 110, 112, 114, 116 being connected to a single frame (i.e., they do not have to be adjusted independently from one another, which could prove to require various tries).

Then, the removable work surface 100 can be mounted to the framing assembly 101 by pivoting down the rear of the removable work surface 100 such that the rear left finger 110 abuts the surface 182*a* of the stud 180*a*, the front left finger 114 abuts the surface 184*a* of the stud 180*a*, the rear right finger 112 abuts the surface 182*a* of the stud 180*b* and the front right finger 116 abuts the surface 184*b*. When the removable work surface 100 is mounted to the framing assembly 101, the front left and right fingers 114, 116 are vertically higher than the rear left and right fingers 110, 112.

The pinning portion 164 of the pins 160 are pinned into the studs 180*a*, 180*b*, which can prevent and/or limit the removable work surface 100 from slipping in the vertical direction. It will be appreciated that the pins 160 can be further inserted into the studs 180*a*, 180*b* by adjusting their position via their handling portion 162. It will be appreciated that due to the orientation of the pins 160 and the frame 102, the weight of the removable work surface 100 increases pressure on the pins 160, which further reinforces the connection to the supporting assembly 101.

The removable work surface 100 can easily be removed from the supporting assembly 100 by pivoting the removable work surface 100 away from the studs 180*a*, 180*b*, which would space the pins 160 from the studs 180*a*, 180*b*, laterally tilting the removable work surface 100 such that the fingers 110, 112, 114, 116 are no longer positioned to abut the studs 180*a*, 180*b*, and then pulling the removable work surface 100 away from the framing assembly 101.

Modifications and improvements to the above-described embodiments of the present technology may become apparent to those skilled in the art. The foregoing description is intended to be exemplary rather than limiting. The scope of the present technology is therefore intended to be limited solely by the appended claims.

What is claimed is:

1. A removable work surface comprising:

a frame defining a first lateral side and a second lateral side;

a supporting surface connected to the frame and defining a first plane;

a first finger connected to the frame, the first finger extending laterally outwardly from the first lateral side of the frame;

a second finger connected to the frame, the second finger extending laterally outwardly from the first lateral side of the frame, and being spaced from the first finger along a length of the first lateral side of the frame;

a third finger connected to the frame, the third finger extending laterally outwardly from the second lateral side of the frame; and a fourth finger connected to the frame, the fourth finger extending laterally outwardly from the second lateral side of the frame, and being spaced from the third finger along a length of the second lateral side of the frame, wherein:

the first finger, the second finger and part of the first lateral side of the frame generally form a c-shape, with a space defined between outer ends of the first finger and the second finger being open, the first finger and the second finger define a second plane substantially parallel to the first plane; and the third finger, the fourth finger and part of the second lateral side of the frame generally form a c-shape, with a space defined between outer ends of the third finger and the fourth finger being open.

2. The removable work surface of claim 1, wherein:

the removable work surface is configured to be selectively mounted to a supporting assembly, the supporting assembly having a first supporting member with a first surface and a second surface opposite the first surface, and a second supporting member laterally spaced from the first supporting member, the second supporting member having a third surface and a fourth surface opposite the third surface, and with the removable work surface being connected to the supporting assembly:

the first finger abuts the first surface;

the second finger abuts the second surface;

the third finger abuts the third surface; and the fourth finger abuts the fourth surface.

3. The removable work surface of claim 1, further comprising a gripping member connected to one of the first finger, the second finger, the third finger, and the fourth finger.

4. The removable work surface of claim 3, wherein a position of the gripping member relative to the one of the first finger, the second finger, the third finger, and the fourth finger is adjustable.

5. The removable work surface of claim 4, wherein the gripping member is threadedly engaged to the one of the first finger, the second finger, the third finger, and the fourth finger.

6. The removable work surface of claim 3, wherein the gripping member is a pin.

7. The removable work surface of claim 6, wherein the pin is oriented at an angle with respect to the supporting surface.

8. The removable work surface of claim 7, wherein the angle is an acute angle extending below the supporting surface.

9. The removable work surface of claim 3, wherein:

the first finger is a first rear finger, the second finger is a first front finger;

the third finger is a second rear finger;

the fourth finger is a second front finger; and the gripping member is connected to one of the first rear finger and the second rear finger.

10. The removable work surface of claim 3, wherein:

the gripping member is a first gripping member connected to one of the first finger and the second finger; and the removable work surface further comprises a second gripping member connected to one of the third finger and the fourth finger.

11. The removable work surface of claim 10, wherein:

the first finger is a first rear finger, the second finger is a first front finger;

the third finger is a second rear finger;

the fourth finger is a second front finger;

the first gripping member is connected to the first rear finger, and the second gripping member is connected to the second rear finger.

12. The removable work surface of claim 1, wherein the frame includes:

a first frame member disposed on the first lateral side;

a second frame member disposed on the second lateral side;

a first connecting member connected to the first frame member, the first connecting member being selectively moveable relative to the first frame member between a first position and a second position; and a second connecting member connected to the second frame member, the second connecting member being selectively moveable between a third position and a fourth position, and the first finger is connected to the first frame member;

the second finger is connected to the first connecting member;

the third finger is connected to the second frame member; and the fourth finger is connected to the second connecting member.

13. The removable work surface of claim 12, wherein:

the first frame member is at least partially hollow, and the first connecting member is received in part in the first frame member; and the second frame member is at least partially hollow, and the second connecting member is received in part in the second frame member.

14. The removable work surface of claim 12, wherein:

each one of the first frame member and the second frame member defines a first aperture;

each one of the first connecting member and the second connecting member defines a second aperture and a third aperture, the removable work surface further includes a first peg and a second peg;

with the first connecting member being:

in the first position relative to the first frame member, the first aperture of the first frame member is aligned with the second aperture of the first connecting member, and the first peg is received in the first aperture of the first frame member and the second aperture of the first connecting member; and in the second position relative to the first frame member, the first aperture of the first frame member is aligned with the third aperture of the first connecting member, and the first peg is received in the first aperture of the first frame member and the third aperture of the first connecting member;

with the second connecting member being:

in the third position relative to the second frame member, the first aperture of the second frame member is aligned with the second aperture of the second connecting member, and the second peg is received in the first aperture of the second frame member and the second aperture of the second connecting member; and in the fourth position relative to the second frame member, the first aperture of the second frame member is aligned with the third aperture and the second peg is received in the first aperture of the second frame member and the third aperture of the second connecting member.

15. The removable work surface of claim 1, wherein the supporting surface is generally flat.

16. The removable work surface of claim 1, further comprising a lip member extending at least partially between the first lateral side and the second lateral side and being disposed at a rear end of the supporting surface.

17. The removable work surface of claim 1, further comprising a retainer connected to at least one of the frame and the supporting surface.

18. The removable work surface of claim 17, wherein the retainer is connected to the frame, and extends from the first lateral side to the second lateral side.

19. The removable work surface of claim 17, wherein the retainer is an elastic cord.

20. The removable work surface of claim 1, wherein the frame defines a channel slidingly receiving the supporting surface.

* * * * *